US005449242A

United States Patent [19]

Salamone

[11] Patent Number: 5,449,242

[45] Date of Patent: Sep. 12, 1995

[54] EAR SUPPORTED WRITING INSTRUMENT HOLDER

[76] Inventor: Thomas Salamone, 1220 Walnut Ave., Bohemia, N.Y. 11716

[21] Appl. No.: 228,384

[22] Filed: Apr. 15, 1994

[51] Int. Cl.[6] ..... B43K 29/00; B43K 31/00; B43K 23/00

[52] U.S. Cl. ..... 401/131; 24/10 R; 24/11 FE; 401/6

[58] Field of Search ..... 24/11 FE, 10 R, 11 CT, 24/3 A, 3 C; 401/6, 131

[56] References Cited

U.S. PATENT DOCUMENTS

| | | | |
|---|---|---|---|
| D. 182,341 | 3/1958 | Pitcher | 401/131 X |
| 743,399 | 11/1903 | Seebold et al. | 24/11 FE |
| 4,596,335 | 6/1986 | Hull | 401/6 X |

*Primary Examiner*—Steven A. Bratlie
*Attorney, Agent, or Firm*—Galgano & Burke

[57] ABSTRACT

A writing instrument holder includes an ear clip receivable and supportable on an ear of a wearer, and a clamp attached to the ear clip for releasably clamping a writing instrument. The holder is specifically intended for holding carpenters' pencils.

6 Claims, 1 Drawing Sheet

EAR SUPPORTED WRITING INSTRUMENT HOLDER

BACKGROUND OF THE INVENTION

1. Field of the Invention

The present invention relates to an ear supported writing instrument holder. More particularly, it relates to such an ear supported writing instrument holder which is especially intended for a carpenter's pencil.

2. Prior Art

As is well-known, carpenter's pencils are different from typically round pencils having a symmetrical polygonal cross-section in that the carpenter's pencils have a rectangular cross sectional profile with two opposite short sides and two opposite long sides so as to produce a flat shaped point, thereby producing a very narrow pencil line for marking lumber to be cut, etc. When working, carpenters will normally place the pencil or other writing instrument by which they can mark a size lumber to be cut and make other dimensional measurements by placing the writing instrument when not in use behind their ear. While a round or a symmetrical polygonal pencil will normally stay behind one's ear, this is not true with a carpenter's pencil as it will easily fall out from behind one's ear. As a result, or the only alternative for the carpenter is to keep the pencil in his or her pocket which renders it not readily accessible. Accordingly, while various patents have been disclosed for providing various types of holder for writing instruments, (see for example, U.S. Pat. Nos. 4,798,455, 4,852,221, 3,266,111, and 3,038,377), none specifically deal with the problem of holding a carpenter's pencil in a readily accessible, facile and easy manner as herein proposed.

SUMMARY OF THE INVENTION

Accordingly, it is an object of the present invention to provide a novel ear supported writing instrument holder which is simple in design, easy to use and which is specifically designed for holding carpenter pencils.

It is a further object of the present invention to provide such a novel writing instrument which is economical to fabricate, lightweight and highly effective in use.

Certain of the foregoing and related objects are readily attained in a ear supported writing instrument holder embodying the present invention which includes an ear clip receivable and supportable on an ear of a wearer, and clamp means for releasably clamping a writing instrument, which clamp means is attached to the ear clip. Preferably, the ear clip has a generally C-shaped configuration and the clamp means includes friction fit engagement means for clamping and grasping a writing instrument.

Most desirably, the frictional fit engagement means is generally U-shaped and comprises a pair of spaced-apart, resilient, tong-like arms which are suitably dimensioned and configured to frictionally clamp and grasp a writing instrument therebetween. Most advantageously, the tong-like arms each have an inwardly-directed tab for engaging the writing instrument. The holder is preferably made from plastic and the clip and clamp means are integrally formed.

In a particularly preferred embodiment of the invention, the C-shaped ear clip has a base member which is intended to rest atop the wearer's ear, a rearwardly-curved arcuate forward leg attached to the forward end of its base member which is intended to wrap around a front portion of the wearer's ear and a generally rectilinear rear leg depending from the rear end of base member which is intended to wrap around a rear portion of the wearer's ear.

BRIEF DESCRIPTION OF THE DRAWINGS

Other objects and features of the present invention will become apparent from the following detailed description considered in connection with the accompanying drawing which disclose one embodiment of the present invention. It should be understood, however, that the drawing is designed for the purpose of illustration only and not as a definition of the limits of the invention.

In the drawing, wherein similar reference characters denote similar elements throughout the several views.

BRIEF DESCRIPTION OF THE PREFERRED EMBODIMENT

Figure 1:
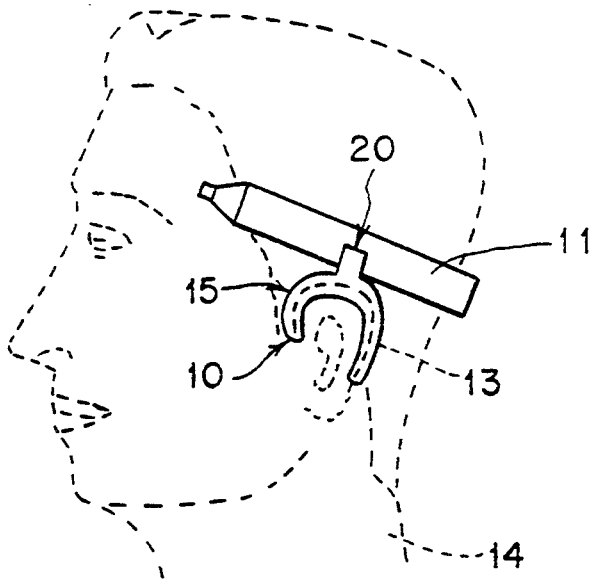
FIG. 1 is a perspective view showing the writing instrument holder of the present invention being used to support a carpenter's pencil behind or atop the ear of a wearer who is shown in phantom view.

Referring now in detail to the drawing, and in particular FIG. 1 thereof, therein illustrated is a novel writing instrument holder embodying the present invention, generally designated by reference numeral 10, which is specifically intended for supporting a carpenter's pencil 11 above or behind the ear 13 of the wearer 14. As seen best in FIG. 1, the writing instrument holder 10 includes a generally C-shaped ear clip, generally designated by reference numeral 15, which fits over the top and behind the wearer's ear 13. The C-shaped ear clip 15 includes a central base wall 16, the forward end of which is attached to a rearwardly curved forward leg 17 and the rear end of which is attached to a generally downwardly depending rectilinear rear leg 18. The central base wall 16 is intended to rest atop and behind the ear, the forward arcuate leg 17 is intended to wrap around the top forward portion of the wearer's ear 13 and the downwardly depending rear leg 18 is intended to wrap around the top portion of the rear of the wearer's ear 13 so as to provide a stable support atop the wearer's ear.

Figure 3:
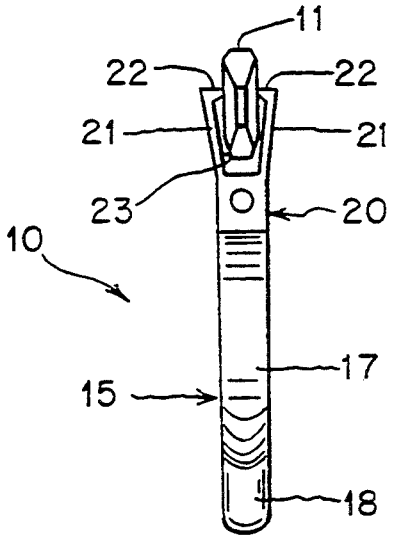
FIG. 3 is a front elevational view of the writing instrument holder supporting a carpenter's pencil.
Figure 2:
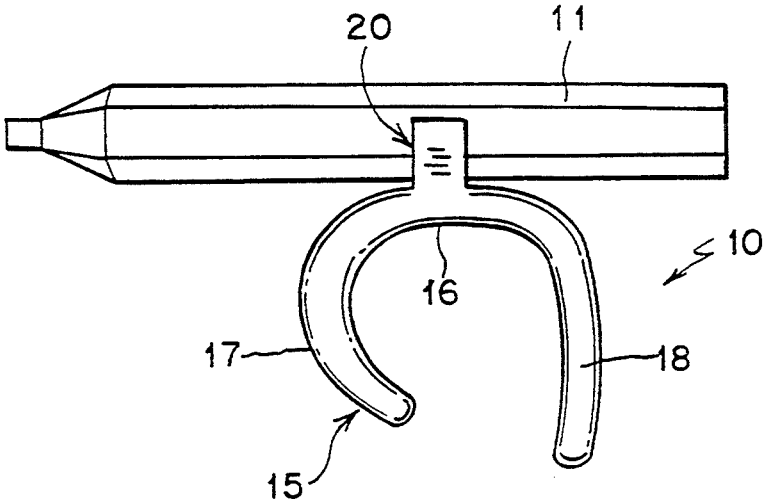
FIG. 2 is an enlarged, side elevational view of the writing instrument holder supporting a carpenter's pencil.

As seen best in FIGS. 2 and 3, secured generally centrally to the base wall is an upstanding, generally U-shaped, resilient, writing instrument-receiving clamp, generally designated by reference numeral 20, composed of a pair of spaced apart, upwardly-extending resilient arms 21, each having a free end with an inwardly-directed tip 22. The arms 21 are configured and dimensioned so that their tips 22 will form a friction fit with the carpenter's pencil 11 when the same is inserted therebetween. As can be appreciated, when the pencil 11 is inserted between the arms 21, the same will resiliently expand outwardly to allow for the full insertion of the pencil 11 into the channel 23 between the two arms 21. In order for the wearer to remove the pencil 11, he simply needs to pull upwardly on the pencil 11 to remove the same from its frictional engagement and retention between the arms 21 of the clamp 20.

The ear supported writing instrument holder 10 is preferably formed from plastic and the ear clip 15 and pencil clamp 20 are preferably integrally formed so as to define a one piece construction. As can be appreciated, the configuration of the ear clip 15 can be modified so long as it provides a stable support on one's ear and, similarly, the friction-fit clamping means can also be modified in terms of its construction and dimensions so long as it enables and provides a quick clamping and release of the carpenter's pencil. Of course, the holder could also be used for supporting other types of writing instruments, although it has been especially found useful for carpenters' pencils for the reasons previously advanced.

Accordingly, while one embodiment of the present invention has been shown and described, it is to be understood that many changes and modifications may be made thereunto without departing from the spirit and scope of the invention as disclosed herein.

What is claimed is:

1. A writing instrument holder for supporting and in combination with a pencil having a substantially rectangular cross section having opposite flat faces comprising an ear clip receivable and supportable on an ear of a wearer; and clamp means for releasably clamping said pencil, said clamp means being attached to said ear clip;

said clamp means comprising a pair of upwardly extending resilient, tong-like arms spaced apart and each arm having at the upper end thereof an inwardly directed tip facing each other and terminating so that the space between oppositely facing tips is less than the thickness of said pencil between opposite flat faces whereby when said pencil is placed in said clamp means said arms are forced apart so that said inwardly directing tips are in frictional engagement with said opposite flat faces of said pencil thereby holding said pencil in place.

2. The writing instrument holder of claim 1, wherein said ear clip has a generally C-shaped configuration.

3. The writing instrument holder of claim 2, wherein said C-shaped ear clip has a base member which is intended to rest atop and behind the wearer's ear, a rearwardly-curved arcuate forward leg attached to said base member which is intended to wrap around a front portion of the wearer's ear and a generally rectilinear rear leg depending from said base member which is intended to wrap around a rear portion of the wearer's ear.

4. The writing instrument holder of claim 1 in which said ear clip has a forward, C-shaped curved leg and a rearward, generally straight leg longer than the forward curved leg.

5. The writing instrument holder of claim 4 in which said ear clip has a base member which is intended to rest atop and behind the wearer's ear.

6. The writing instrument holder of claim 1, wherein said holder is made from plastic and said clip and clamp means are integrally formed.

* * * * *